US006044496A

United States Patent [19]

Ramírez

[11] Patent Number: 6,044,496

[45] Date of Patent: Apr. 4, 2000

[54] WAISTBAND EXPANDER

[76] Inventor: Maria Elisa Ramírez, Calle Cabalbb 70, Levittown, Puerto Rico 00949

[21] Appl. No.: 09/244,143

[22] Filed: Feb. 4, 1999

[51] Int. Cl.[7] ..... A41D 1/14

[52] U.S. Cl. ..... 2/219; 2/227; 2/235; 2/237

[58] Field of Search ..... 2/321, 322, 336, 2/219, 220, 221, 227, 235–237; 223/63, 77; 38/102.3; 24/371, 72.7, 369, 370, 378.1

[56] References Cited

U.S. PATENT DOCUMENTS

| | | | |
|---|---|---|---|
| 718,768 | 1/1903 | Joslin | 24/573.1 |
| 1,792,128 | 2/1931 | Stevenson | 24/72.7 |
| 2,585,689 | 2/1952 | Schafer | 2/141 |
| 2,675,559 | 4/1954 | Miller | 2/234 |
| 4,429,439 | 2/1984 | Waugh | 24/573 |
| 4,580,298 | 4/1986 | Tuisl | 2/237 |
| 5,263,617 | 11/1993 | Martin | 223/63 |

*Primary Examiner*—Gloria Hale
*Assistant Examiner*—Tejash Patel
*Attorney, Agent, or Firm*—Ezra Sutton

[57] ABSTRACT

The present invention provides a waistband expander for engaging the button and button-hole on a garment to increase the fastened distance between the button and button-hole to provide comfort to the wearer. The waistband expander includes a central shaft having a first end and a second end, a button-engaging member connected to the first end for engaging a button on a garment, and a button-hole engaging member connected to the second end for engaging a button hole on the garment so as to increase the fastened distance between the button and button-hole to provide comfort to the wearer.

18 Claims, 2 Drawing Sheets

WAISTBAND EXPANDER

FIELD OF THE INVENTION

This invention relates to a waistband expander to be used by a person who has gained weight, such that the waistband expander extends the waist size of the user's garment at least one-half of an inch.

BACKGROUND OF THE INVENTION

Clips, fasteners, and coupling devices for closing or fastening apparel and clips used in conjunction with clothing accessories for increasing a belt length have taken many forms in relation to appearance, functionality, shape, and material of construction. Generally, various types of clips or fasteners have structures that are utilized in conjunction with the button hole and button of the garment or accessory that is needed to be expanded or increased a size measurement. The use of such devices increases the use of a particular clothing item even when the user has gained weight or has outgrown his/her garment size.

There remains a need for a waistband expander for increasing and extending the waist size of a garment, such that one end of the waistband expander surrounds the waist button and the other end passes through the button hole. Different lengths and sizes of the waistband expander will be available for men, women, and children's clothing. In addition, the waistband expander may have a cover-up buckle attached to the clip for an ornamental and decorative appearance as a replacement for a belt.

DESCRIPTION OF THE PRIOR ART

Prior art clips, fasteners, and coupling devices used in conjunction with apparel and clothing accessories for increasing a garment size or accessory length have been constructed in various ways with regard to appearance, functionality, shape and materials of construction. For example, U.S. Pat. No. 623,103 discloses a clip having a hole for receiving a hook and a yieldable clamp for increasing a belt size. U.S. Pat. No. 718,768 discloses a suspender fastener having a button section for engaging a button and a hooking section for engaging a suspender. U.S. Pat. No. 1,792,128 discloses a coupling device having a button-engaging section and a hook section for supporting trousers in connection with an undershirt.

None of the prior art patents disclose the particular structure of the present invention for use as a waistband expander.

Accordingly, it is an object of the present invention to provide a waistband expander for increasing and extending the waist size of a garment that is of a compact configuration and easy to use.

Another object of the present invention is to provide a waistband expander having different styles, lengths and sizes for use in men's, women's, and children's clothing.

Another object of the present invention is to provide a waistband expander having a cover-up buckle attached to the waistband expander for an ornamental and decorative appearance and for the optional replacement of a belt when desired.

Another object of the present invention is to provide a waistband expander that is made from a light-weight, durable plastic, a light-weight metal, or a light-weight rubber.

A further object of the present invention is to provide a waistband expander that can be mass produced in an automated and economical manner and is readily affordable by the user.

SUMMARY OF THE INVENTION

The present invention provides a waistband expander for engaging the button and button-hole on a garment to increase the fastened distance between the button and button-hole to provide comfort to the wearer. The waistband expander includes a central shaft having a first end and a second end, a button-engaging member connected to the first end for engaging a button on a garment, and a button-hole engaging member connected to the second end for engaging a button hole on the garment so as to increase the fastened distance between the button and button-hole to provide comfort to the wearer.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED AND ALTERNATE EMBODIMENTS

Figure 1:
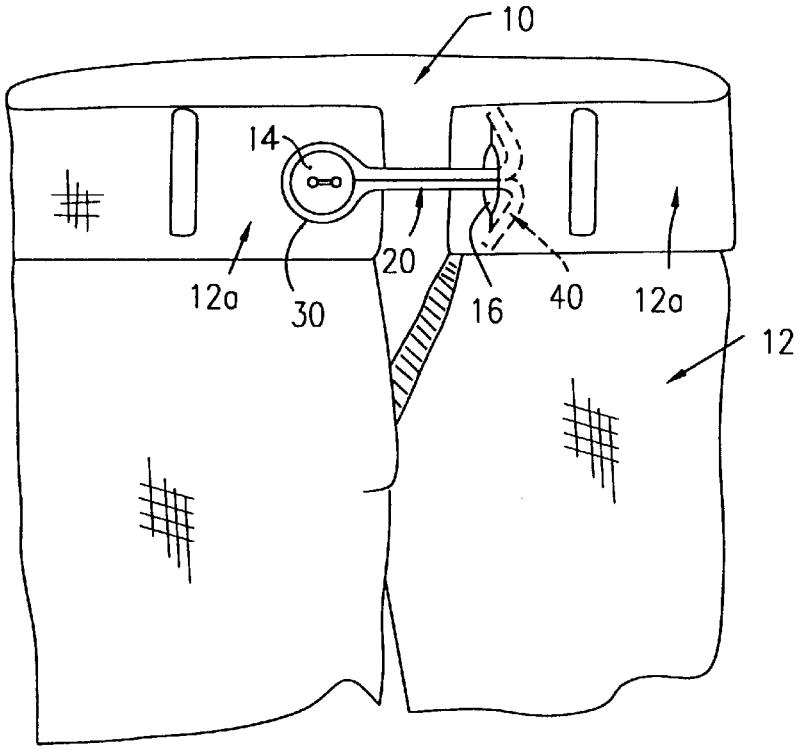
FIG. 1 is a front perspective view of the waistband expander of the preferred embodiment of the present invention showing its attachment to a clothing garment.
Figure 2:
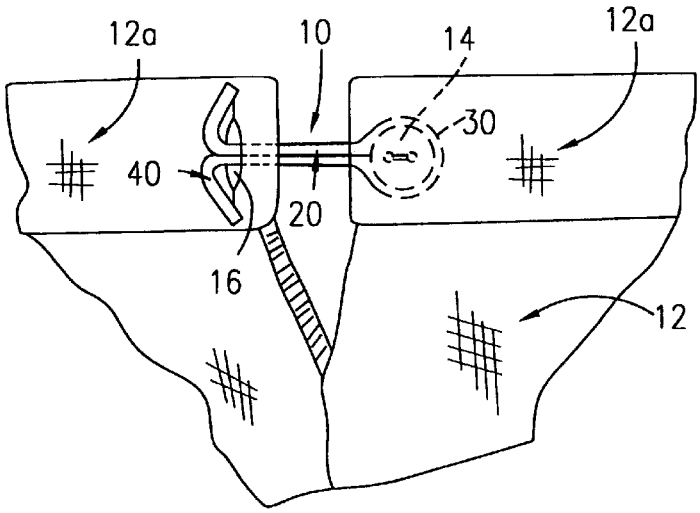
FIG. 2 is a rear view of the waistband expander of the preferred embodiment of the present invention showing its attachment to a clothing garment.
Figure 3:
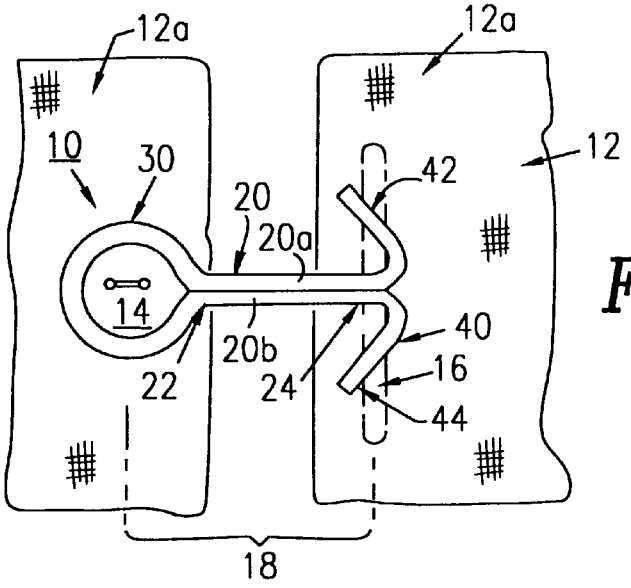
FIG. 3 is an enlarged front view of the waistband expander of the preferred embodiment of the present invention illustrating its parts in detail.
Figure 4:
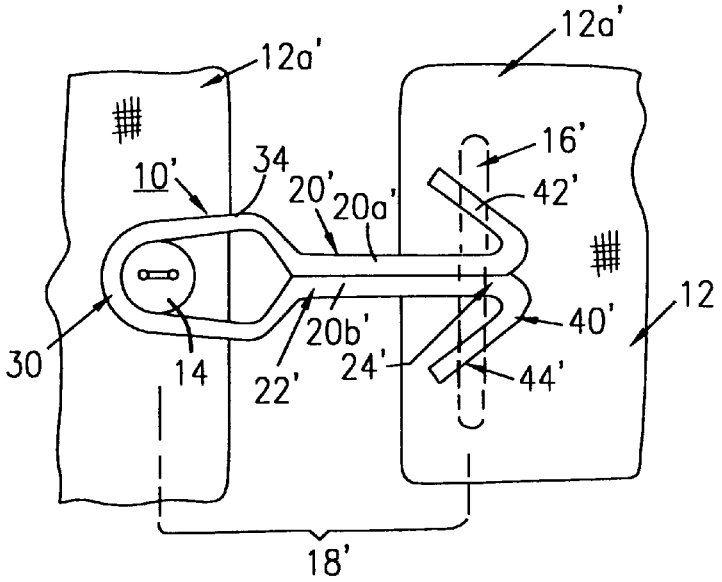
FIG. 4 is an enlarged front view of the waistband expander of the second embodiment of the present invention illustrating its parts in detail.
Figure 5:
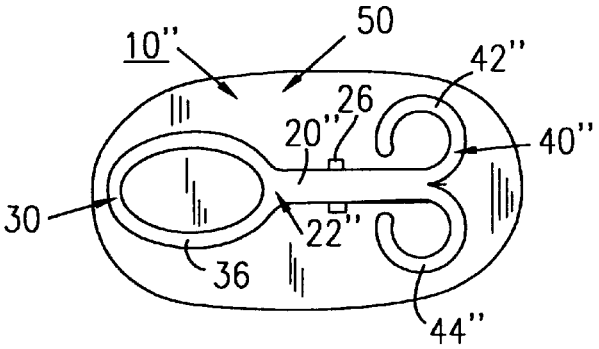
FIG. 5 is an enlarged rear view of the waistband expander of the third embodiment of the present invention showing an ornamental cover attached thereto.

The preferred embodiment of the present invention provides a waistband expander 10, as represented in FIGS. 1 to 3, for use on the waistband 12*a* of a garment 12. The alternate embodiments of the present invention provide for waistband expanders 10' and 10", as represented in FIG. 4 and 5, for use on garments 12'. FIG. 5 also shows an ornamental buckle 50 attached to the central shaft 20" of waistband expander 10".

THE PREFERRED EMBODIMENT

The waistband expander 10 of the preferred embodiment is used for engaging the button 14 and button-hole 16 on a garment 12 to increase the fastened distance 18 between the button 14 and button-hole 16 to provide comfort to the wearer. Expander 10 includes a central shaft 20 having a first end 22 and a second end 24. The central shaft 20 is formed of two co-linear and parallel sections 20*a* and 20*b*. A button-engaging member 30 is connected to the first end 22 for engaging a button 14 on garment 12. A button-hole engaging member 40 is connected to the second end 24 and includes a first leg 42 and a second leg 44, wherein each diverges outwardly at an approximately 45° degree angle from the second end 24. However, the angle may vary and be within a range of more than 30° and less than 90° relative to the central shaft 20. The first and second legs 42 and 44 are for engaging and passing through the button-hole 16 for fastening expander 10 to the button-hole 16. The expander 10 increases the fastened distance 18 between the button 14 and button-hole 16 to provide comfort to the wearer.

It should be understood that the term button as used herein is intended to include regular buttons, snap buttons, and any other type of fastening means for garments. Further, fastening distance 18 is defined to mean the expanded distance provided by the present invention between the button hole 16 and the button 14, which fastened distance is normally zero since the button overlaps the button hole. For example, a person with a 35" waist can use the expander 10 of the present invention and still comfortably wear a 34" waistband, since the expander 10 can increase the fastening distance 18 one inch. It should be understood that the waistband expander of the present invention can increase the fastening distance of the garment by ½ inch to 2 inches.

The waistband expander 10 may be manufactured from one piece of plastic, rubber, or metal wherein the central shaft 20 is formed of two co-linear sections 20*a* and 20*b*, as shown in FIG. 3. Alternatively, the central shaft 20" of waistband expander 10" may be formed having only a single section by means of die molding or metal stamping, as shown in FIG. 5.

ADDITIONAL EMBODIMENTS

The second embodiment of waistband expander 10', as depicted in FIG. 4, has the same structure and functions in the same manner as the preferred embodiment of waistband expander 10, except for the elongated and trapezoidal shape 34 of the button-engaging member 30', as compared to the circular shape 32 of the preferred embodiment. Trapezoidal-shaped member 34 increases the fastened distance 18'.

The third embodiment of waistband expander 10", as depicted in FIG. 5, functions in the same manner as the preferred embodiment of waistband expander 10, except for the oval shape 36 of the button-engaging member 30", as compared to the circular shape 32 of the preferred embodiment 10. Also, the button-hole engaging legs 42" and 44" are substantially circular in shape, as compared to the straight sections of the first and second legs 42 and 44 of the preferred embodiment 10 for engaging button-hole 16. In addition, waistband expander 10" has a central shaft 20" formed of a single section, as compared to the two co-linear sections 20*a* and 20*b* of central shaft 20 of the preferred embodiment 10. Further, it includes an ornamental cover or buckle 50 attached to the midpoint 26 of central shaft 20" by means of welding, gluing, stapling, or the like.

OPERATION OF THE PRESENT INVENTION

The waistband expander 10, 10', and 10" is easy to use by the wearer when he or she has outgrown a particular garment 12 having a waistband 12*a*, such as, leisure shorts, pants, trousers, culottes, skirts, or the like, but the wearer still wants to use and wear that garment. As shown in FIGS. 1 to 5, the wearer first attaches the button-engaging member 30, 30', and 30" of waistband expander 10, 10', and 10" to the button 14 or 14' of garment 12 or 12'. The wearer then inserts the button-hole engaging member 40, 40', or 40", by passing the first and second legs 42 and 44, or 42' and 44', or 42" and 44", through the button hole 16 or 16' of garment 12 or 12' to engage and fasten it. The wearer can still wear his or her standard belt over the expander 10 or 10' for keeping garment 12 or 12' in a proper place on the wearer's waist. The wearer of waistband expander 10, 10', or 10" should be able to extend the waist size of that garment 12 or 12' one or two clothing sizes for the comfort of the wearer, and at least one inch.

In the third embodiment, the waistband expander 10" having the ornamental buckle 50 allows the wearer to use the expander 10" as previously mentioned, but in addition, it can be used instead of a belt to hold-up garment 12 or 12' of the wearer.

ADVANTAGES OF THE PRESENT INVENTION

Accordingly, an advantage of the present invention is that it provides for a waistband expander for increasing and extending the waist size of a garment that is of a compact configuration and easy to use.

Another advantage of the present invention is that it provides for a waistband expander having different styles, lengths and sizes for use in men's, women's, and children's clothing.

Another advantage of the present invention is that it provides for a waistband expander having a cover-up buckle attached to the waistband expander for an ornamental and decorative appearance and for the optional replacement of a belt when desired.

Another advantage of the present invention is that it provides for a waistband expander that is made from a light-weight, durable plastic, a light-weight metal, or a light-weight rubber.

A further advantage of the present invention is that it provides for a waistband expander that can be mass produced in an automated and economical manner and is readily affordable by the user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A waistband expander for engaging the button and button-hole on a garment to increase the fastened distance between the button and button-hole on the waist of the garment to provide comfort to the wearer, comprising:

a) the waistband expander including a central longitudinally-extending shaft for bridging the gap between the button and button-hole located on the waist of the garment and having a first end and a second end;

b) a button-engaging member connected to said first end for engaging a button on the waist of the garment;

c) a button-hole engaging member connected to said second end for engaging a button-hole on the waist of the garment so as to bridge said gap and to increase the fastened distance between the button and button-hole located on the waist of the garment to expand the waist of the garment to provide comfort to the wearer; and d) said button-hole engaging member includes a first leg and a second leg each of which diverge in opposite directions from said second end and each of which extend in a direction toward said button-engaging member, said first leg and said second leg each diverge at an angle of more than 30° and less than 90° relative to said central shaft, the ends of said first and second legs being spaced from said central shaft for passing through and engaging the button-hole to increase the fastened distance between the button and button-hole located on the waist of the garment to expand the waist of the garment.

2. A waistband expander in accordance with claim 1, wherein said button-engaging member is circular, oval, or elliptical in shape.

3. A waistband expander in accordance with claim 1, wherein said central shaft is formed of two co-linear sections.

4. A waistband expander in accordance with claim 1, wherein said central shaft is formed of a single section and is at least one half inch in length.

5. A waistband expander in accordance with claim 1, wherein said waistband expander is made of plastic, rubber, or metal.

6. A waistband expander in accordance with claim 1, further including an ornamental cover attached to said expander.

7. A waistband expander for engaging the button and button-hole on a garment to increase the fastened distance between the button and button-hole on the waist of the garment to provide comfort to the wearer, comprising:

a) the waistband expander including a central longitudinally-extending shaft for bridging the gap between the button and button-hole located on the waist of the garment and having a first end and a second end;

b) a button-engaging member connected to said first end for engaging a button on the waist of the garment;

c) a button-hole engaging member connected to said second end for engaging a button-hole on the waist of the garment so as to bridge said gap and to increase the fastened distance between the button and button-hole located on the waist of the garment to expand the waist of the garment to provide comfort to the wearer; and d) said button-hole engaging member includes a first leg and a second leg, each of which extend from said second end and in a direction toward said button-engaging member, said first and second legs each being curved in shape, the ends of said first and second legs being spaced from said central shaft for passing through and engaging the button-hole to increase the fastened distance between the button and button-hole located on the waist of the garment to expand the waist of the garment.

8. A waistband expander in accordance with claim 7, wherein said button-engaging member is circular, oval, or elliptical in shape.

9. A waistband expander in accordance with claim 7, wherein said central shaft is formed of two co-linear sections.

10. A waistband expander in accordance with claim 7, wherein said central shaft is formed of a single section and is at least one half inch in length.

11. A waistband expander in accordance with claim 7, wherein said waistband expander is made of plastic, rubber, or metal.

12. A waistband expander in accordance with claim 7, further including an ornamental cover attached to said expander.

13. A waistband expander for engaging the button and button-hole on a garment to increase the fastened distance between the button and button-hole on the waist of the garment to provide comfort to the wearer, comprising:

a) the waistband expander including a central longitudinally-extending shaft for bridging the gap between the button and button-hole located on the waist of the garment and having a first end and a second end;

b) a button-engaging member connected to said first end for engaging a button on the waist of the garment;

c) a button-hole engaging member connected to said second end for engaging a button-hole on the waist of the garment so as to bridge said gap and to increase the fastened distance between the button and button-hole located on the waist of the garment to expand the waist of the garment to provide comfort to the wearer; and d) said button-hole engaging member includes a first leg and a second leg, each of which extend from said second end and in a direction toward said button-engaging member for passing through and engaging the button-hole to increase the fastened distance between the button and button-hole located on the waist of the garment to expand the waist of the garment.

14. A waistband expander in accordance with claim 13, wherein said button-engaging member is circular, oval, or elliptical in shape.

15. A waistband expander in accordance with claim 13, wherein said central shaft is formed of two co-linear sections.

16. A waistband expander in accordance with claim 13, wherein said central shaft is formed of a single section and is at least one half inch in length.

17. A waistband expander in accordance with claim 13, wherein said waistband expander is made of plastic, rubber, or metal.

18. A waistband expander in accordance with claim 13, further including an ornamental cover attached to said expander.

* * * * *